US006594969B2

(12) United States Patent
Laroche

(10) Patent No.: US 6,594,969 B2
(45) Date of Patent: Jul. 22, 2003

(54) EQUIPMENT FOR ASSEMBLING PRODUCTS SUCH AS PACKAGES FOR COMPACT DISCS

(75) Inventor: Francis Laroche, Puymoyen (FR)

(73) Assignee: Esatec Etudes Services Automatismes Techniques S.A. (FR)

( * ) Notice: Subject to any disclaimer, the term of this patent is extended or adjusted under 35 U.S.C. 154(b) by 0 days.

(21) Appl. No.: 09/908,137

(22) Filed: Jul. 18, 2001

(65) Prior Publication Data

US 2002/0013205 A1 Jan. 31, 2002

(30) Foreign Application Priority Data

Jul. 24, 2000 (FR) ..... 00 09686

(51) Int. Cl.[7] ..... B65B 1/04; B66C 1/00

(52) U.S. Cl. ..... 53/254; 53/202; 53/250; 414/737

(58) Field of Search ..... 53/235, 254, 532, 53/202, 250; 414/737

(56) References Cited

U.S. PATENT DOCUMENTS 5,019,207 A * 5/1991 McCoy
5,163,271 A * 11/1992 Pan et al.
5,285,620 A * 2/1994 Kaye et al.
5,910,078 A * 6/1999 Guttinger et al.
5,943,845 A 8/1999 Ilsemann
6,048,158 A 4/2000 Zaniboni

FOREIGN PATENT DOCUMENTS

DE 34 07 220 A1 8/1985
DE 198 45 384 A1 4/2000

* cited by examiner

*Primary Examiner*—M. D. Patterson
(74) *Attorney, Agent, or Firm*—Piper Rudnick LLP

(57) ABSTRACT

Apparatus for assembling products including at lest one rigid thin part of a first type (in particular a compact disc tray) glued on a plane part of a second type (in particular a casing formed by a pre-cut cardboard matrix), including at least one suction belt for carrying the planar parts of the second type, at least one loader for feeding a gripping device with the parts of the first type and at least one gripping device comprising a turntable turning around a transversal axis parallel to the tray, the turntable supporting a plurality of sucker supports for gripping the parts of the first type and depositing them on the parts of the second type, characterized in that the sucker support has a configuration able to ensure displacement of the sucker corresponding to a degree of freedom in translation parallel to a single radial axis only.

11 Claims, 8 Drawing Sheets

EQUIPMENT FOR ASSEMBLING PRODUCTS SUCH AS PACKAGES FOR COMPACT DISCS

FIELD OF THE INVENTION

This invention relates to the field of machines intended for the assembly of products such as packages. In particular, the invention concerns machines for assembling packages formed by glueing several complementary parts, generally rigid or semi-rigid plane parts. One of the parts is generally formed by a cut-out cardboard matrix, and folded during the manufacturing phase or after assembly.

BACKGROUND

In the prior art, equipment is described in French Patent FR 2664883. This equipment is adapted for setting semi-rigid windows on a cardboard matrix. On the other hand, it is not adapted to setting a rigid part on a cardboard matrix, since the gripping movement of the part coming from a feeder produces slight deformation unacceptable in the case of rigid parts.

The problem posed is to allow rigid articles to be unstacked and then deposited on a support such as a cardboard matrix, using rapid and reliable equipment.

SUMMARY OF THE INVENTION

This invention relates to apparatus for assembling products which includes at least one substantially rigid thin first part glued on a substantially planar second part, including at least one suction pad for carrying the planar second part, at least one loader for feeding a gripping device with the first part, and at least one gripping device including a turntable rotating about a transverse axis substantially parallel to the tray, the turntable supporting a plurality of suction supports for gripping the first part and depositing the first part on the second part, wherein the suction support has a configuration which ensures displacement of a sucker corresponding to a degree of freedom in translation parallel to a single radial axis only.

BRIEF DESCRIPTION OF THE DRAWINGS

The invention will be better understood by reading the description of a non-limiting example of embodiment given below, referring to the diagrams in the appendix in which.

DETAILED DESCRIPTION

Figure 3:
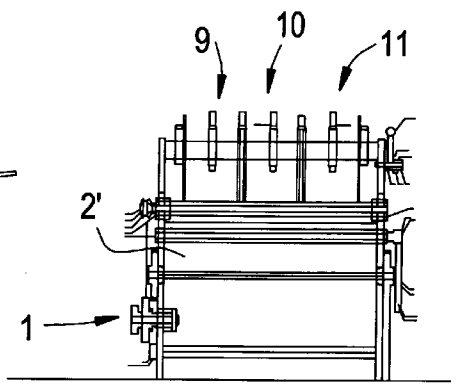
FIG. 3 shows a rear view of the equipment of FIG. 1.

It will be appreciated that the following description is intended to refer to specific embodiments of the invention selected for illustration in the drawings and is not intended to define or limit the invention, other than in the appended claims.

In its most general form, the invention relates to a piece of equipment for assembling products comprising at least one rigid thin part of a first type (in particular, a compact disc tray) glued on a planar part of a second type (in particular, a casing formed by a pre-cut cardboard matrix), comprising at least one suction belt for carrying the planar parts of the second type, at least one loader for feeding a gripping device with parts of the first type, and at least one gripping device comprising a turntable turning around a transverse axis parallel to the tray, the turntable supporting a plurality of suction supports for gripping the parts of the first type and depositing them on the parts of the second type, characterized in that the suction support has a configuration able to ensure displacement of the suction corresponding to a degree of freedom in translation parallel to a single radial axis.

Such equipment is intended especially for assembling compact disc casings, formed by a folded cardboard matrix and a tray in molded or thermoformed plastic with a recess for placing a CD.

According to a preferred embodiment, the suction support comprises a rigid connecting rod with one end mobile in translation around an axis parallel to a radial axis, relative to a guide rotationally free relative to the turntable, and whose other end is mobile in rotation relative to an oscillating drive arm. According to an advantageous variant, the drive arm is controlled by a motor in an oscillatory movement relative to a closely radial median position.

Advantageously, the turntable is driven according to a rotary movement at a closely constant speed. Preferably, the speed of rotation of the turntable is a slave in function of the relative position of the part of the second type and the part of the first type in a detection zone comprised between the loader and the deposit zone. According to a preferred variant, the turntable comprises a plurality of suction supports.

According to a particular embodiment, the equipment comprises a coaxial drive crown with the turntable, the crown ensuring the oscillation of the drive arms. According to a variant, it comprises at least one first feeder for taking a first rigid article and at least one second feeder for taking a second article, the two feeders being offset angularly relative to the turntable.

Advantageously, the first feeder is intended to receive articles (for example, compact discs) intended to be inserted into the second articles (for example, trays for compact discs).

According to another variant, it comprises a plurality of parallel assemblies each comprising a belt and a turntable provided with suction supports, as well as at least one loader.

According to a further variant, the turntables provided with suction supports are offset longitudinally.

Figure 1:
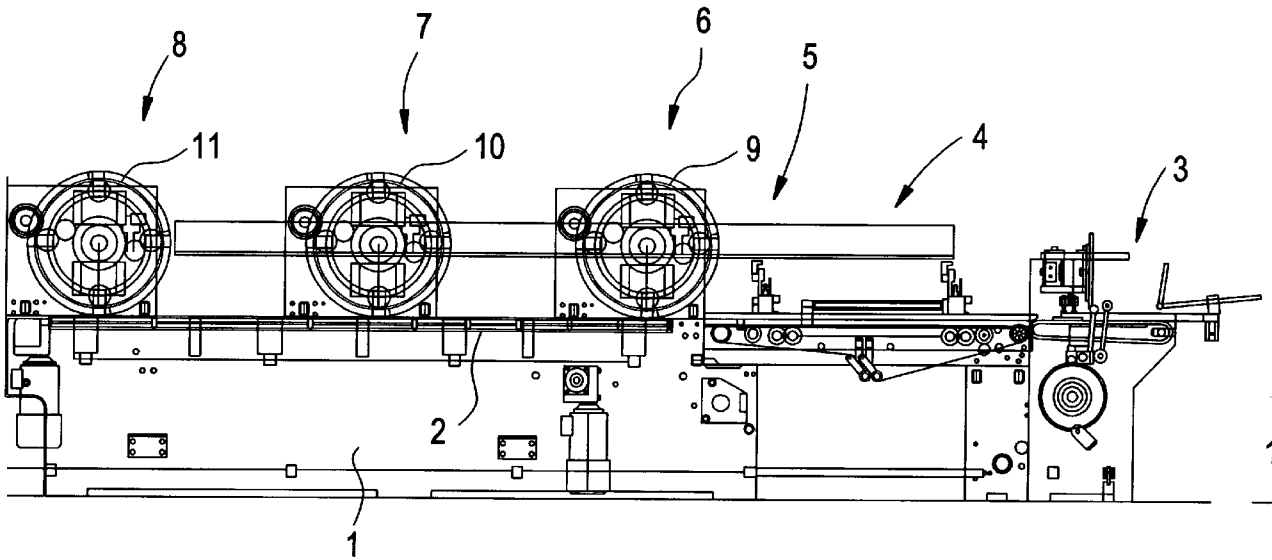
FIG. 1 shows a front view of equipment according to the invention.
Figure 2:
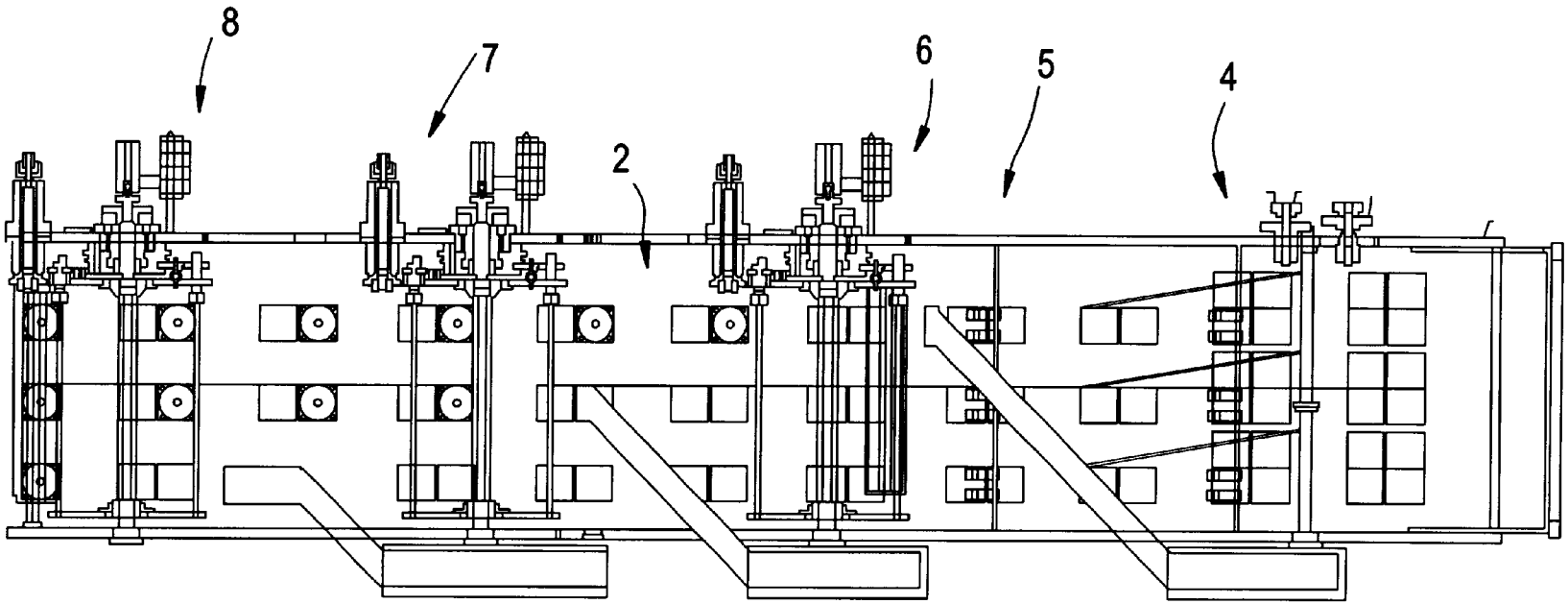
FIG. 2 shows a side view of the equipment of FIG. 1.

Turning now to the drawings in general and FIGS. 1–3 in particular, the equipment described as a non-limiting example comprises a frame 1 supporting a conveyor belt 2 set on a suction inlet box.

This belt 2 is supplied by feeders 3 on which pre-cut cardboard matrixes are piled. The equipment comprises gluing stations using methods known in the prior art, 4 and 5, as well as a plurality of deposit stations, 6 to 8.

The deposit stations each comprise a turntable, 9 to 11, offset longitudinally. The deposit stations will be described in more detail with reference to FIGS. 4 to 9. They comprise a turntable 9 driven by a motorized rotation shaft 12. This turntable, in the example described, supports three suction supports 13 (to aid understanding, the Figs. only show one of these supports).

The suction support 13 comprises:

a rigid connecting rod 14;

an oscillating drive arm 15; and a guide 16 mounted in free rotation relative to the shaft 12 and the turntable 9.

The rigid connecting rod 14 is generally "L" shaped with a cylindrical rod 20 and an extension 21 at right angles. The rod 20 slides in a linear bearing mounted in a guide 16 which can pivot freely relative to the turntable 9.

The rod 20 extends along a direction closely parallel to a radial axis passing along the principal axis 12 and the drive shaft 23 of the oscillating arm 21. The right-angled extension 21 of the connecting rod 14 'supports a sucker 17 whose suction axis is substantially parallel to the rod 20.

The right-angled extension 21 of the connecting rod 14 is linked to the drive arm 15 by a pivot 22. This arm 15 is integral with a shaft 23 driven by a motorized assembly 24. This assembly provokes oscillating movement of the arms 15.

Figure 4:
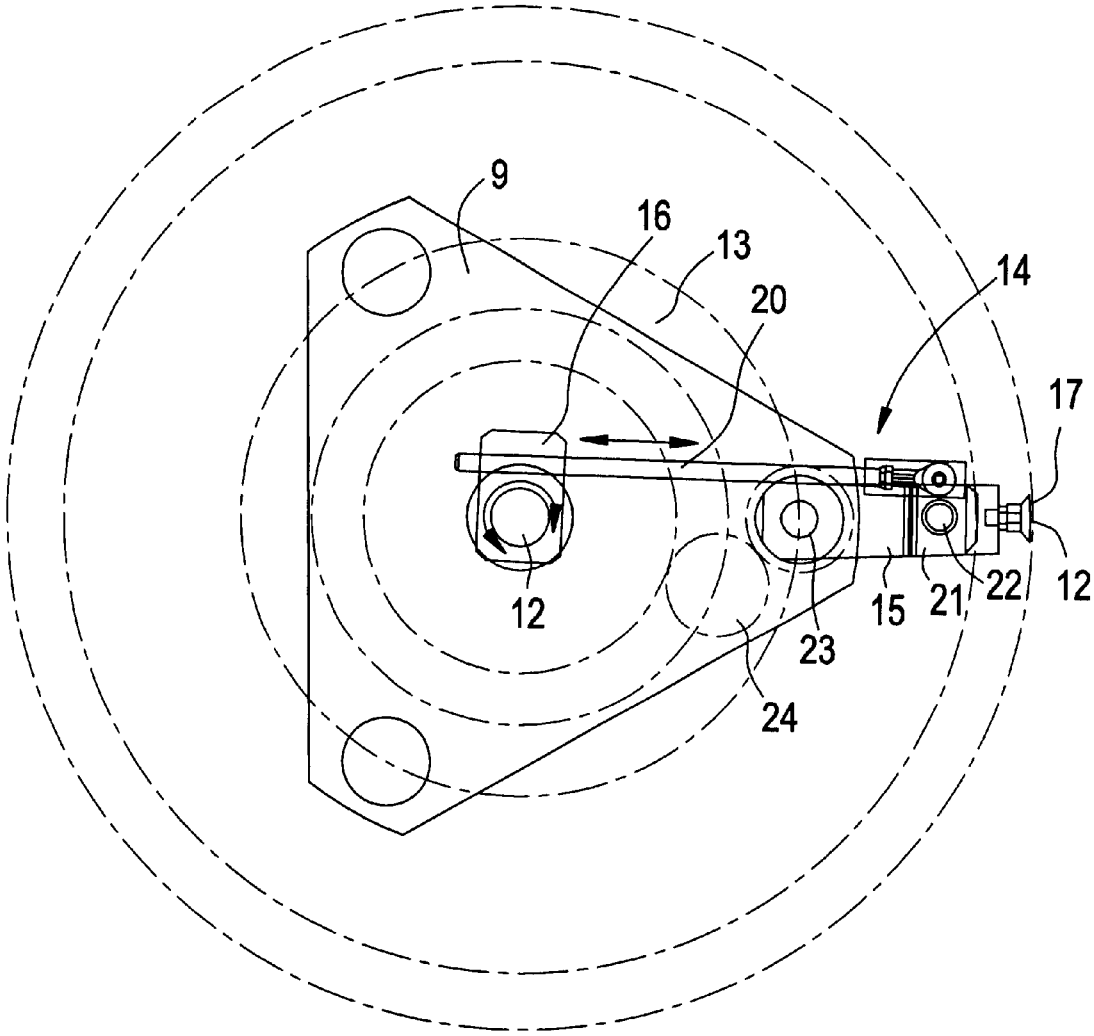
FIGS. 4 to 9 show detailed views of the turntable at consecutive stages.

FIG. 4 shows the turntable at the moment of gripping a rigid part. In this position, the sucker 17 has a bearing surface substantially parallel to the surface of the article to be gripped, in this case a vertical surface. The sucker 17 is in its maximum extension position, the distance between the bearing surface 28 of the sucker and the central shaft 12 being at the maximum.

Figure 5:
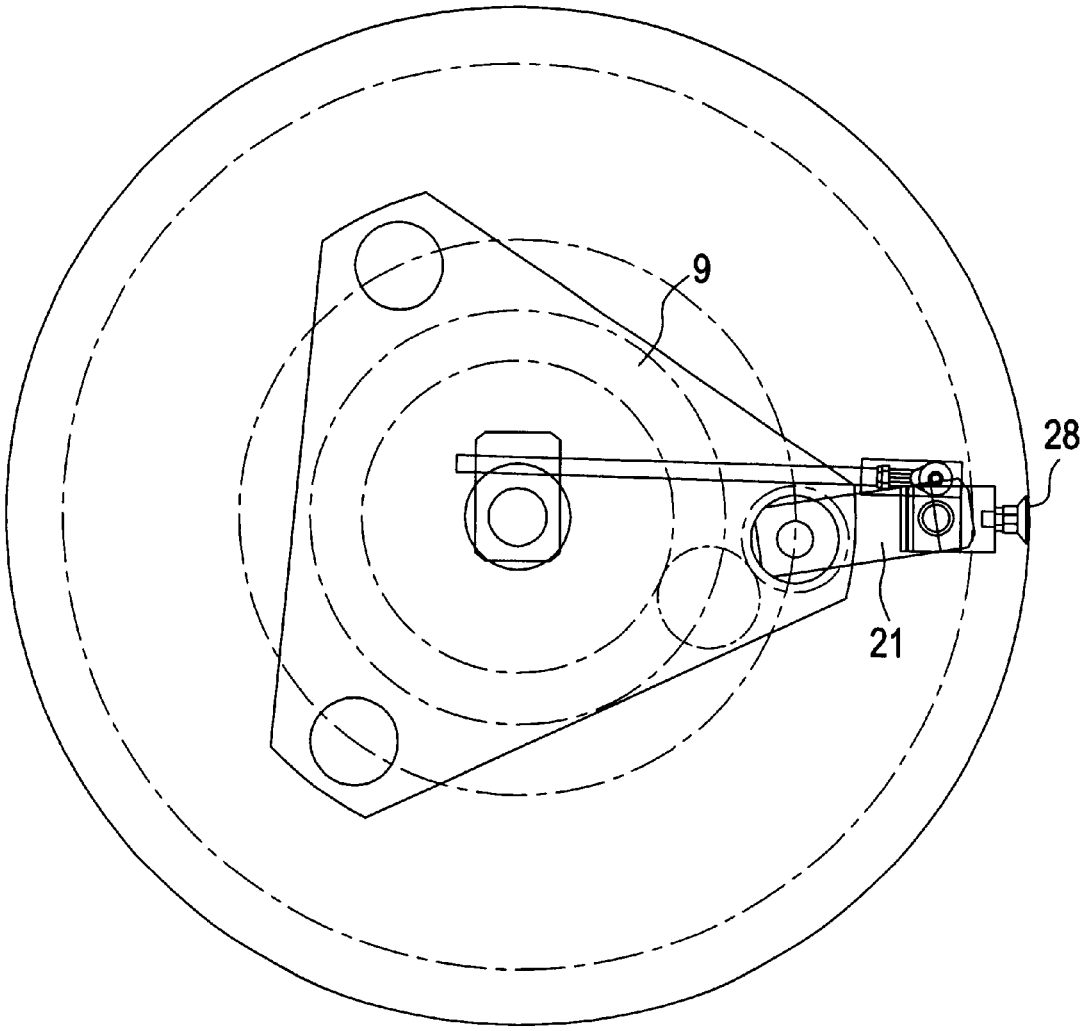
Figure 6:
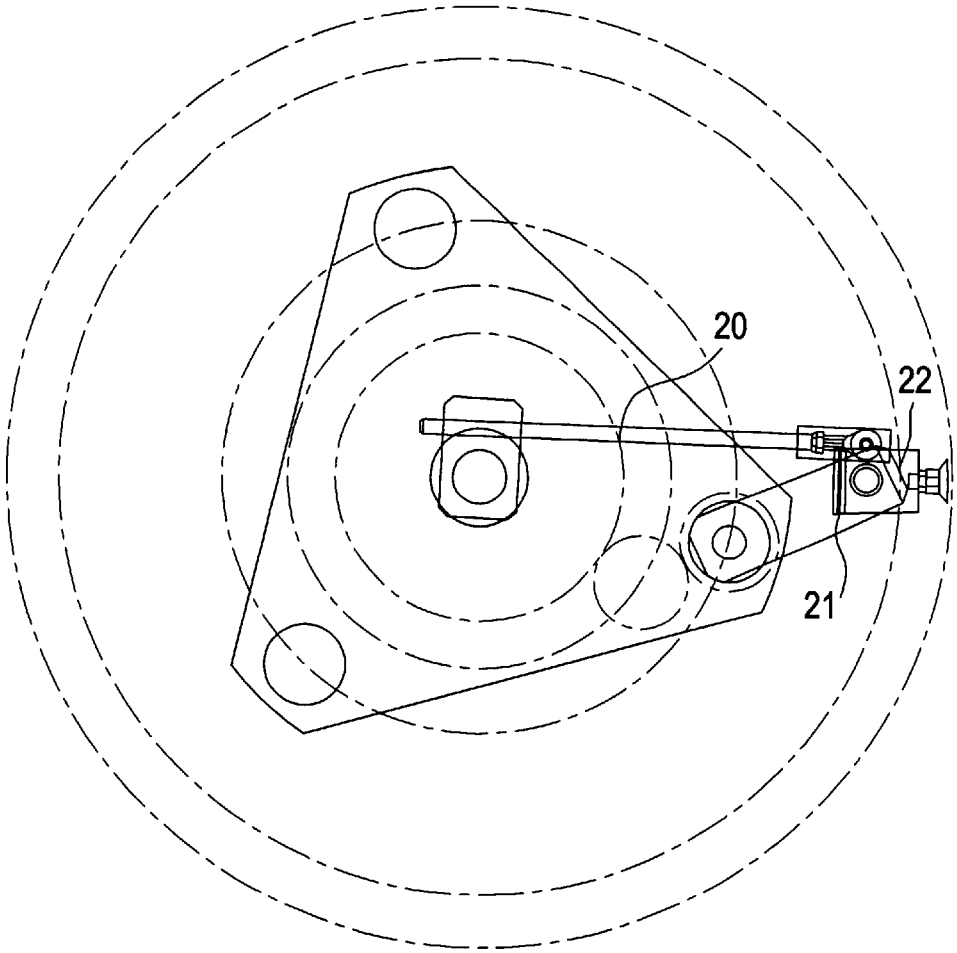

FIGS. 5 and 6 show the turntable after rotations through several degrees. The oscillating arm 21 is driven rotationally in the direction opposite to that of the main turntable 9 to compensate for the effect of rotation of the main turntable 9, and to keep the bearing surface 28 parallel to the surface of the rigid parts. The addition of these two rotational movements results in a centripetal linear displacement of the sucker 17, which carries the gripped rigid part following a linear displacement. In this way, tilting of this rigid part is avoided.

Figure 7:
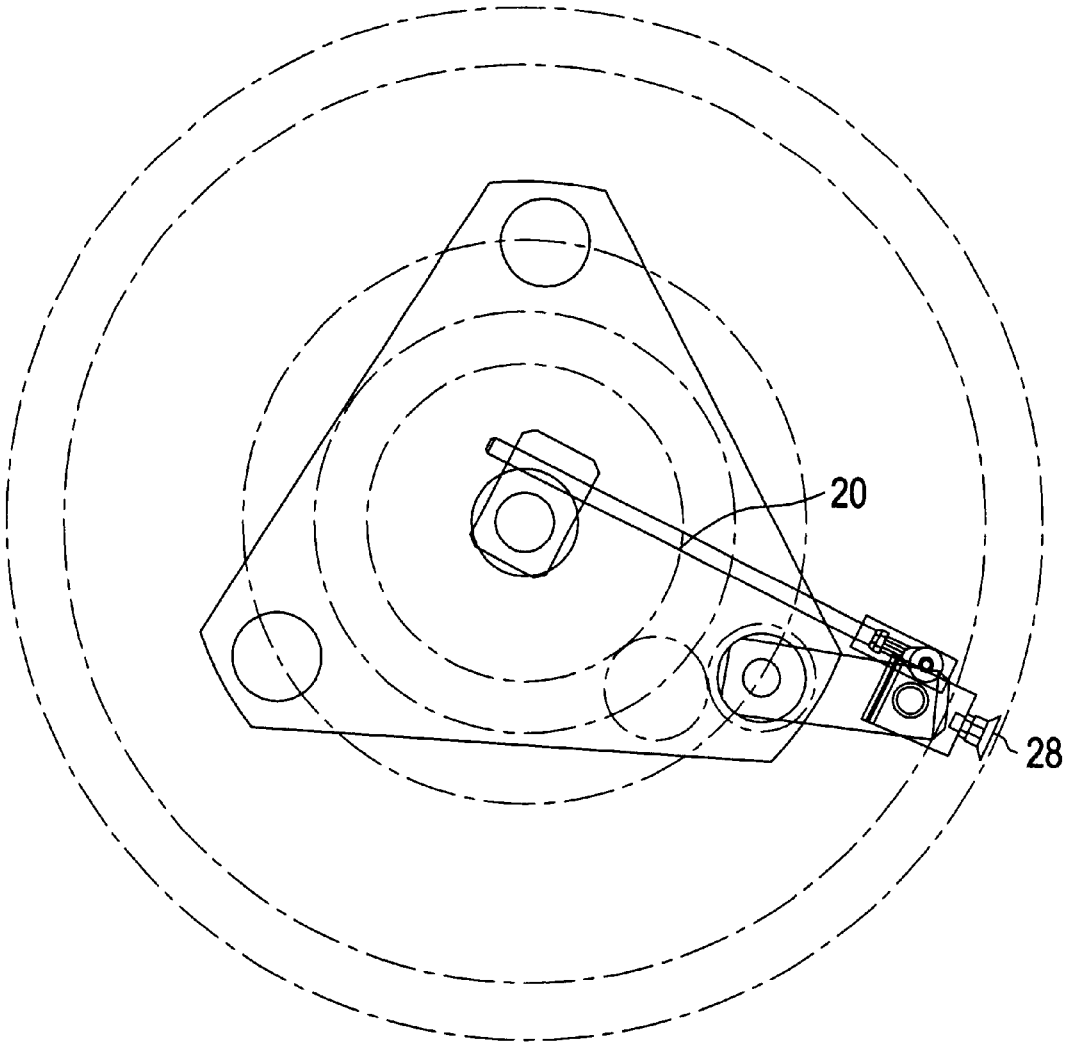
Figure 8:
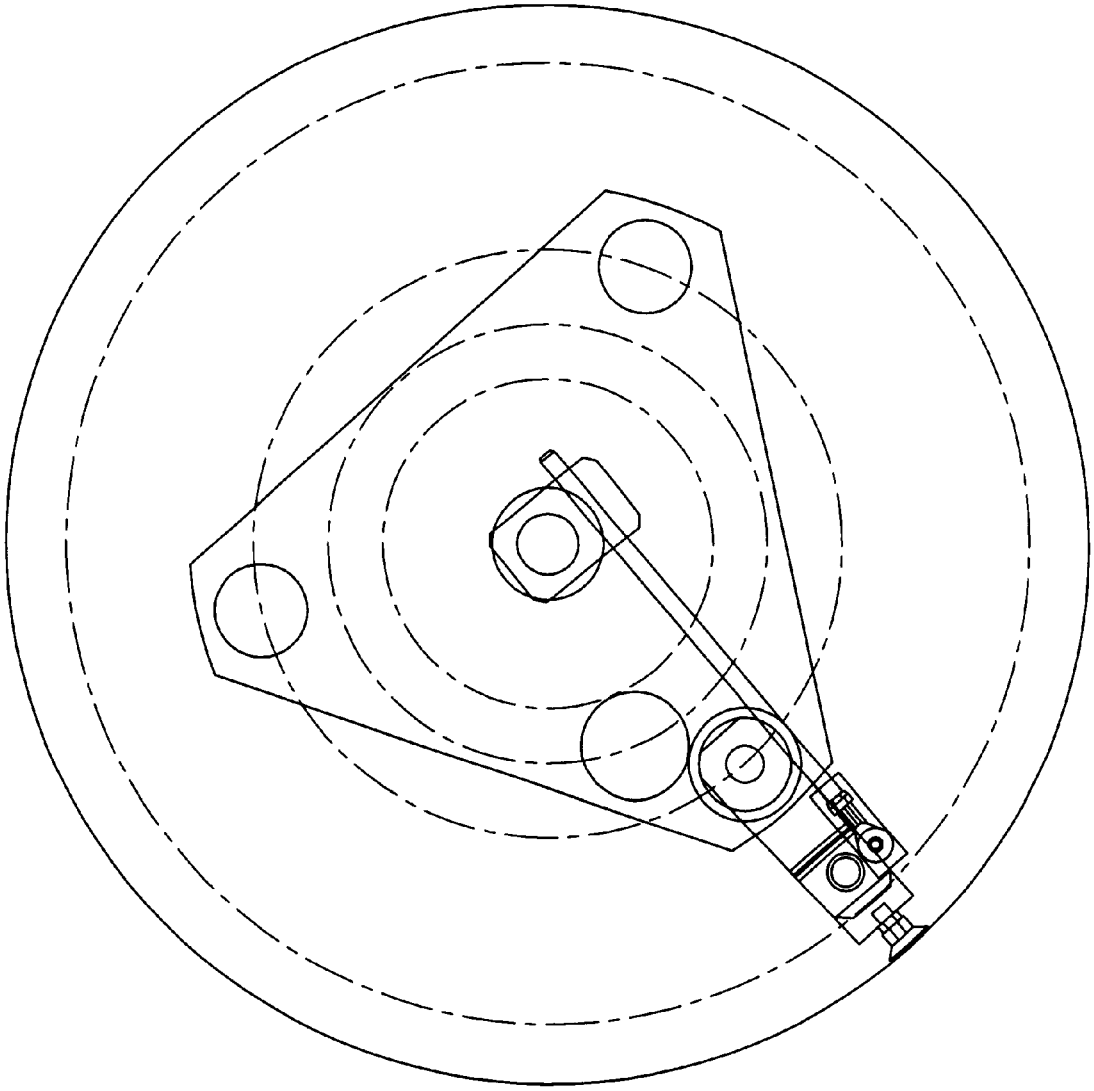

When the sucker is in a position close to the central axis 12 as shown in FIG. 6, the pivoting of the arm 21 stops, and then the direction of rotation is reversed, which provokes tilting of the sucker 17, as shown in FIG. 7.

Figure 9:
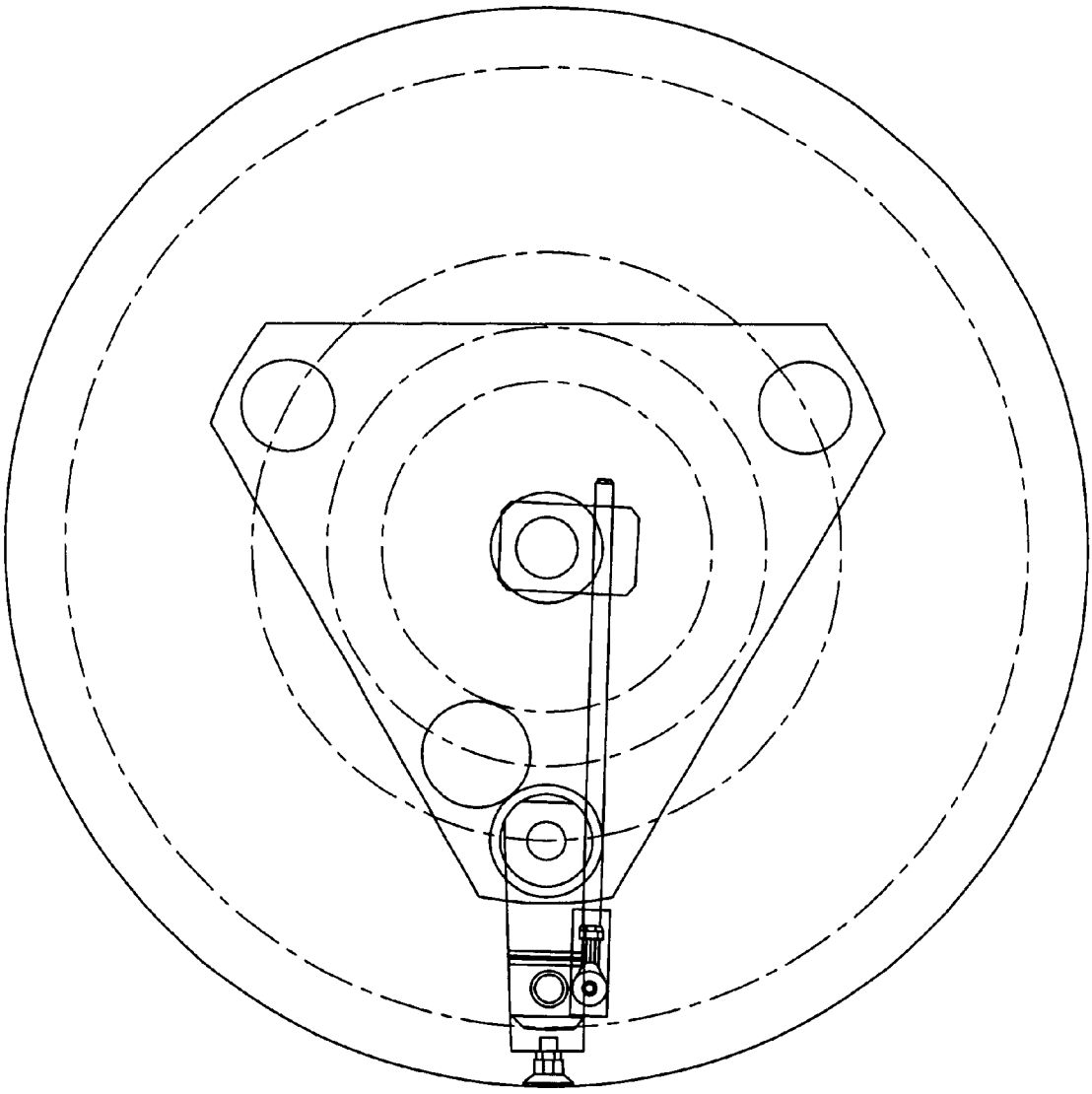

The arm 21 takes on a radial position as shown in FIG. 9 when the rigid part comes into contact with the cardboard matrix.

The equipment can be adapted to allow a compact disc to be gripped coming from a first loader, and then the compact disc is supported as far as the thermoformed tray coming from the second loader, the assembly then being applied to the cardboard matrix for gluing.

The speed of rotation of the turntable and/or the suction belt can be adjusted as a function of a control signal received from a detector of the passage of the rigid part. In the event of a time lag of passage in relation to a reference, the turntable and/or belt are accelerated or slowed to compensate for the time lag.

What is claimed is:

1. Apparatus for assembling a product which includes at least one substantially rigid thin first part glued on a substantially planar second part, comprising:

at least one suction pad for carrying the planar second part;

at least one loader for feeding a gripping device with the first part; and at least one gripping device comprising a turntable rotating about a transverse axis substantially parallel to a tray, the turntable supporting a plurality of suction supports for gripping the first part and depositing the first part on the second part, wherein the suction support has a configuration which ensures displacement of a sucker corresponding to a degree of freedom in translation parallel to a single radial axis only.

2. The apparatus according to claim 1, wherein the suction support comprises a rigid connecting rod with one end mobile in translation along an axis substantially parallel to a radial axis, relative to a guide in free rotation relative to the turntable, and with another end mobile in rotation relative to an oscillating drive arm.

3. The apparatus according to claim 2, wherein the drive arm is controlled by a motor in oscillating movement relative to a closely radial median position.

4. The apparatus according to claim 1, wherein the turntable is driven according to a rotational movement at a substantially constant speed.

5. The apparatus according to claim 4, wherein the speed of rotation of the turntable is a slave to the relative position of the second part and the first part in a detection zone formed between the feeder and the deposit zone.

6. The apparatus according to claim 1, wherein the turntable comprises a plurality of suction supports.

7. The apparatus according to claim 6, wherein the turntable has a coaxial drive crown, said crown ensuring oscillation of the drive arms.

8. The apparatus according to claim 6, further comprising at least one first feeder for gripping a first rigid article and at least one second feeder for gripping a second article, the two feeders being offset angularly relative to the turntable.

9. The apparatus according to claim 8, wherein the first feeder receives articles for insertion into the second articles.

10. The apparatus according to claim 1, further comprising a plurality of parallel assemblies, each assembly comprising a pad and a turntable provided with suction supports, as well as at least one loader.

11. The apparatus according to claim 10, wherein the turntables provided with suction supports are longitudinally offset.

* * * * *